US005906115A

United States Patent [19]

Driggars et al.

[11] Patent Number: 5,906,115

[45] Date of Patent: May 25, 1999

[54] LOW-SHRINKAGE STABLE PRINT PLATFORM KNITTED FABRIC

[75] Inventors: Sonny B. Driggars, Advance; Charles J. Lyerly, Clemmons, both of N.C.

[73] Assignee: Saramar Corporation, Winston-Salem, N.C.

[21] Appl. No.: 08/971,429

[22] Filed: Nov. 17, 1997

[51] Int. Cl.[6] ..... D04B 1/04

[52] U.S. Cl. ..... 66/191; 442/308

[58] Field of Search ..... 66/191, 169 R; 442/308, 312

[56] References Cited

U.S. PATENT DOCUMENTS

| | | | |
|---|---|---|---|
| Re. 30,638 | 6/1981 | Bryars | 66/191 |
| 1,831,964 | 11/1931 | Lombardi | 66/191 |
| 3,021,698 | 2/1962 | Hill | 66/9 |
| 3,083,439 | 4/1963 | Seligson | 66/191 |
| 4,244,198 | 1/1981 | Schaab et al. | 66/191 |
| 5,613,375 | 3/1997 | Renda et al. | 66/8 |

OTHER PUBLICATIONS

Sara Lee Knit Products SKU/Revision Display Style/Revision Nov. 14, 1997.

*Primary Examiner*—Andy Falik

*Attorney, Agent, or Firm*—Rhodes Coats & Bennett, L.L.P.

[57] ABSTRACT

A low-shrinkage, stable print platform circular knitted fabric. The fabric is a two end fleece fabric having a weight of between about 8 to 12 oz. per sq.yd., a stitch density of between about 800 to 1000; and a face yarn count of said fabric is between about 16 to 20. In the preferred embodiment, the backing yarn count of said fabric is between about 7 to 12. The resulting fabric construction of the present invention has stretch of less than about 3% stretch in the width direction and less than about 3% stretch in the length direction when tested according to a standard stretch chart. In addition the fabric of the present invention has shrinkage in the range of less than 5% when tested according to a standard one wash cycle. The resulting fabric is an exceptionally stable print platform, circular knitted fabric.

16 Claims, 1 Drawing Sheet

LOW-SHRINKAGE STABLE PRINT PLATFORM KNITTED FABRIC

BACKGROUND OF THE INVENTION (1) Field of the Invention

The present invention relates generally to circular knitted fabric and, more particularly, to a two end fleece fabric having a weight of between about 8 to 12 oz. per sq.yd.

(2) Description of the Prior Art

The term circular knitting covers those weft knitting machines having needle beds arranged in circular cylinders and/or dials including latch, bearded and occasionally compound needle machinery. Such machines produce a wide variety of fabric structures, garments, hosiery and other articles and a variety of diameters and machine gauges. Such machines have the needles fixed in a revolving circle with the loop formation and knitting action being achieved by ancillary elements moving yarn and loops along the needle stems producing a fabric tube with the technical face facing backwards.

Large diameter circular knitting machines are generally used to produce either fleece or jersey fabrics as well as other fabric constructions. Because of the seasonal nature of these fabrics, it is usually necessary to maintain both fleece and jersey machines on the knitting floor or to move machines in and out as seasonal fabric demands change. Both approaches are capital and labor cost intensive.

One approach to solving this problem is disclosed in U.S. Pat. No. 5,613,375, issued to Renda et al., the entire disclosure hereby being incorporated by reference. This patent teaches a new and improved circular knitting machine having interchangeable section blocks and sinkers which allow the machine to be converted between producing two end fleece and 4 track jersey fabrics by simply replacing the section blocks, carrier ring, needles and sinkers without the need to strip the machine to its bed or to change the feeders or creel.

The following discussion is taken generally from Spencer, David J., *Knitting Technology,* (2d. ed. 1989), which is a general treatment of knitting technology.

Knitted fabrics are progressively built up by converting newly fed yarn into new loops in the needle hooks, the needles then draw these new loops head first through the old loops, which have been retained from the previous knitting cycle. The needles at the same time release, cast off or knock-over old loops so that they hang suspended by their heads from the feet of the new loops whose heads are still held in the hooks of the needles. A cohesive structure is thus produced by a combination of the intermeshed loops and the yarn joining those loops together through which it passes.

Knitted loops are arranged in rows and columns roughly equivalent to the warp and weft of woven structures termed "courses" and "wales" respectively. A course is a predominately horizontal row of loops (in an upright fabric) produced by adjacent needles during the same knitting cycle. A wale is a predominantly vertical column of needle loops produced by the same needle knitting at successive knitting cycles and thus intermeshing each new loop through the previous loop.

The term "stitch density" is frequently used in knitting instead of a linear measurement of courses and wales, it is the total number of needle loops in a square area measurement such as square inch. It is obtained by multiplying the number of courses per inch by the number of wales per inch. Stitch density tends to be a more accurate measurement because tension acting in one direction in the fabric may, for example, produce a low reading for the courses and a high reading for the wales, which when multiplied together cancel the effect out.

"Yarn count" indicates the linear density (yarn diameter or fineness) to which that particular yarn has been spun. The choice of yarn count is restricted by the type of knitting machine employed and the knitting construction. The yarn count, in turn, influences the cost, weight, opacity, handle and drapability of the resulting knitted structure. In general, staple spun yarns tend to be comparatively more expensive the finer their count, because finer fibers and a more exacting spinning process are necessary in order to prevent the yarn from showing an irregular appearance.

Historically, most systems are associated with particular yarn-spinning systems, for example, a yarn spun on the worsted system from acrylic fibers may be given a worsted count number. The worsted system is of the indirect type based on length per fixed unit mass, i.e., the higher the count number, the finer the yarn. The weight is fixed (1 lb.) and the length unit (number of 560-yard hanks) varies. 1/24's worsted (24×560-hank yards weighing 1 lb.) will be twice the cross-sectional area of 1/48's worsted (48×560-yard hanks weighing 1 lb.). 2/24's worsted indicates that the yarn contains two ends of 1/24's so that the resulting count is twice the cross-sectional area (24/2=12's).

Three end and two end, course cut (10 to 14), knitting techniques are conventionally used to produce knitted fleece with low stitch densities (600–700). Fabric with a higher stitch density is generally perceived to be a higher quality fabric because it has a lower shrinkage rate and a more stable print platform.

Two end, course cut knitting techniques are generally used to produce knitted fleece fabric with lower stitch density, which is generally perceived to be low quality fabric. Two end knitted fleece fabric constructions are typically less costly to produce compared to three end knitted fleece fabric constructions because of lower yarn material costs.

Both three end and two end course cut knitting techniques can be used to produce knitted fleece fabric having the same fabric weight and the same stitch density. However, because three end knitting uses three yarn ends, as opposed to two yarn ends used by two end knitting, a yarn having a finer yarn count, which is significantly more expensive, is necessary to produce knitted fleece fabric with the same fabric weight and same stitch density. Thus, it is much more costly to produce knitted fleece fabric of a given weight and stitch density using a three end knitting technique.

Thus, there remains a need for a new and improved knitted fleece fabric that can be produced economically, and which has a relatively high stitch density and correspondingly low shrinkage rate, and that has an extremely stable print platform. This has been found possible to achieve using a two end, fine cut (greater than about 14) knitting technique using more economical yarns than possible with three ends and a significantly higher stitch density.

SUMMARY OF THE INVENTION

The present invention is directed to a low-shrinkage, stable print platform circular knitted fabric. The fabric is a two end fleece fabric having a weight of between about 8 to 12 oz. per sq.yd., a stitch density of between about 800 to 1000; and a face yarn count of the fabric is between about 16 to 20. In the preferred embodiment, the backing yarn count of the fabric is between about 7 to 12.

In the preferred embodiment, the fabric is formed from an acrylic-free cotton blend. Specifically, the fabric is formed from an acrylic-free cotton blend containing between about 50 to 90 percent cotton and the balance is polyester.

The resulting fabric construction of the present invention has stretch of less than about 3% stretch in the width direction and less than about 3% stretch in the length direction when tested according to a standard stretch chart. In addition the fabric of the present invention has shrinkage in the range of less than 5% when tested according to a standard one wash cycle. The resulting fabric is an exceptionally stable print platform circular knitted fabric.

Accordingly, one aspect of the present invention is to provide a low-shrinkage, stable print platform circular knitted fabric. The fabric includes (a) a two end fleece fabric having a weight of between about 8 to 12 oz. per sq.yd.; and (b) a stitch density of greater than about 800.

Another aspect of the present invention is to provide a low-shrinkage, stable print platform circular knitted fabric. The fabric includes: (a) a two end fleece fabric having a weight of between about 8 to 12 oz. per sq.yd.; and (b) a stitch density of between about 800 to 1000.

Still another aspect of the present invention is to provide a low-shrinkage, stable print platform circular knitted fabric. The fabric including: (a) a two end fleece fabric having a weight of between about 8 to 12 oz. per sq.yd.; (b) a stitch density of between about 800 to 1000; and (c) a face yarn count of the fabric is between about 16 to 20.

These and other aspects of the present invention will become apparent to those skilled in the art after a reading of the following description of the preferred embodiment when considered with the drawings.

DESCRIPTION OF THE PREFERRED EMBODIMENTS

Figure 1:
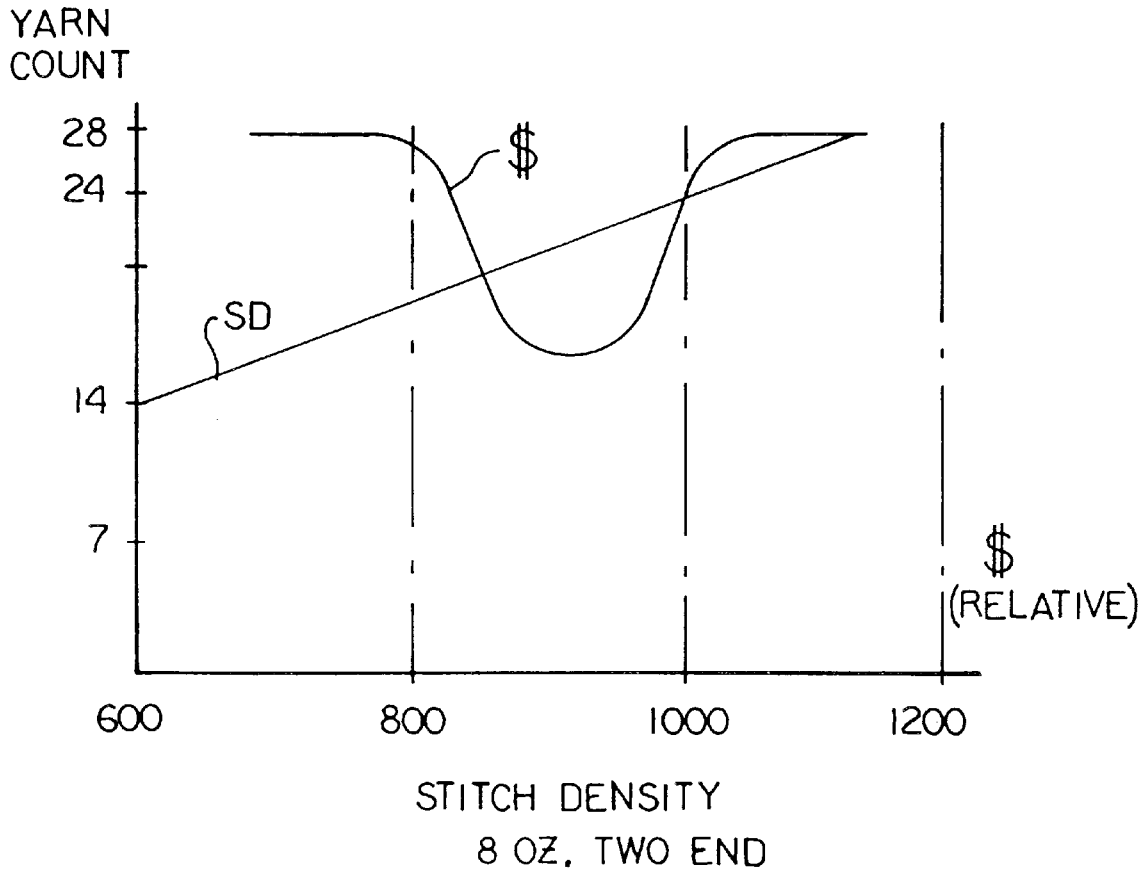
FIG. 1 is a graphical representation illustrating the relationship of face yarn count and cost verses stitch density for a representative 8 oz. fleece fabric constructed according to the present invention.

In the following description, like reference characters designate like or corresponding parts throughout the several views. Also in the following description, it is to be understood that such terms as "forward", "rearward", "left", "right", "upwardly", "downwardly", and the like are words of convenience and are not to be construed as limiting terms.

The present invention can be practiced using the convertible circular knitting machine setforth in the above-referenced U.S. Pat. No. 5,613,375. Such a machine includes a conventional fleece circular knitting machine adaptable to be converted to a jersey circular knitting machine. The knitting machine includes four major subassemblies: a creel having a plurality of yarn packages; a plurality of feeders; a knitting cylinder supported on a bed and having a plurality of needles; and a plurality of fleece section blocks attached to the bed and arranged about the perimeter of the cylinder.

Jersey fabric is usually knit on four feeds per block. Renda et al. '375 found that it was possible to design jersey cams and section blocks that are interchangeable with the fleece section blocks. This allows one cylinder to produce two types of fabric with the same cylinder. All that was necessary is to replace the interchangeable section blocks, the carrier ring, and the needles and sinkers. The cut remains the same as well as the creel and number of feeders.

In knitting fleece, it is necessary to have three yarns to make one course. Only one yarn is necessary to knit a course of jersey fabric. Accordingly, one cam and one yarn will knit one course of jersey fabric. Three cams in each block would make three courses of jersey fabric. Three times 36 jersey section blocks would make 108 courses per cylinder revolution. The more cams around the circumference, the more production.

The conventional fleece section block has two dials associated with two upper feeds each supplying one yarn and a third yarn being supplied to the fleece sinker. It puts the loop in, i.e. the yarn that gets napped for the pile. The fleece section block has a guide on top of the sinker section which feeds yarn into the sinker and the sinker determines the length of the loop it's going to make.

As best seen in FIG. 1, it has been found only two end circular knitted fabric having a limited range of stitch density for a given fabric weight will produce a low shrinkage, stable print platform which is not cost prohibitive. The conventional wisdom of using a three end fleece and increasing the stitch density above the normal range of about 600 requires a corresponding higher yarn count because of the presence of the 3rd yarn. The cost of these higher yarn count yarns increase non-linearly resulting in a fabric which would be twice as expensive as a two end circular knitted fabric produced according to the present invention. This drives the acceptable stitch density ranges of the present invention.

In the preferred embodiment, as taught by Renda et al. '375, the fleece sinkers are adapted for use with the fleece section blocks for producing fleece fabric and the jersey sinkers are adapted for use with the jersey section blocks for producing jersey fabric. Each of the fleece sinkers and each of the jersey sinkers includes a nose, a first throat below the nose and a knit line adjacent to the throat. Each of the fleece sinkers and each of the jersey sinkers have substantially the same outer dimensions to facilitate conversion of the circular knitting machine between production of fleece and jersey fabrics.

Certain modifications and improvements will occur to those skilled in the art upon a reading of the foregoing description. By way of example, the preferred stitch density of the two end fleece fabric is between about 800 to 1000, new developments in yarn manufacture, such as vortex spinning, could reduce yarn costs for finer yarns and allow stitch densities to increase to 1100. Also, while the preferred embodiment is an 8 oz. fabric, the basic techniques of the present invention may allow high stitch density fabrics to increase to 9½ oz. It should be understood that all such modifications and improvements have been deleted herein for the sake of conciseness and readability but are properly within the scope of the following claims.

We claim:

1. A low-shrinkage, stable print platform circular knitted fabric, said fabric comprising:

(a) a two end fleece fabric having a weight of between about 8 to 12 oz. per sq.yd.; and (b) a stitch density of greater than about 800.

2. The fabric according to claim 1, wherein a face yarn count of said fabric is between about 16 to 20.

3. The fabric according to claim 2, wherein a backing yarn count of said fabric is between about 7 to 12.

4. The fabric according to claim 1, wherein said fabric is formed from an acrylic-free cotton blend.

5. The fabric according to claim 4, wherein said fabric formed from an acrylic-free cotton blend contains between about 50 to 90 percent cotton.

6. The fabric according to claim 4, wherein said fabric formed from an acrylic-free cotton blend contains between about 50 to 90 percent cotton and the balance is polyester.

7. A low-shrinkage, stable print platform circular knitted fabric, said fabric comprising:

(a) a two end fleece fabric having a weight of between about 8 to 12 oz. per sq.yd.; and (b) a stitch density of between about 800 to 1000.

8. The fabric according to claim 7, wherein said fabric has stretch of less than about 3% stretch in the width direction and less than about 3% stretch in the length direction when tested according to a standard stretch chart.

9. The fabric according to claim 7, wherein said fabric has shrinkage in the range of less than 5% when tested according to a standard one wash cycle.

10. A low-shrinkage, stable print platform circular knitted fabric, said fabric comprising:

(a) a two end fleece fabric having a weight of between about 8 to 12 oz. per sq.yd.;

(b) a stitch density of between about 800 to 1000; and (c) a face yarn count of said fabric is between about 16 to 20.

11. The fabric according to claim 10, wherein a backing yarn count of said fabric is between about 7 to 12.

12. The fabric according to claim 10, wherein said fabric is formed from an acrylic-free cotton blend.

13. The fabric according to claim 12, wherein said fabric formed from an acrylic-free cotton blend contains between about 50 to 90 percent cotton.

14. The fabric according to claim 12, wherein said fabric formed from an acrylic-free cotton blend contains between about 50 to 90 percent cotton and the balance is polyester.

15. The fabric according to claim 10, wherein said fabric has stretch of less than about 3% stretch in the width direction and less than about 3% stretch in the length direction when tested according to a standard stretch chart.

16. The fabric according to claim 10, wherein said fabric has shrinkage in the range of less than 5% when tested according to a standard one wash cycle.

* * * * *